US010801822B2

(12) United States Patent
Wilson et al.

(10) Patent No.: US 10,801,822 B2
(45) Date of Patent: Oct. 13, 2020

(54) VARIABLE STAND-OFF ASSEMBLY

(71) Applicant: GOODRICH CORPORATION, Charlotte, NC (US)

(72) Inventors: Brian Wilson, Vacaville, CA (US); German Ramirez, Antioch, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 358 days.

(21) Appl. No.: 16/024,207

(22) Filed: Jun. 29, 2018

(65) Prior Publication Data

US 2020/0003533 A1 Jan. 2, 2020

(51) Int. Cl.
*F42B 33/06* (2006.01)
*F42B 1/028* (2006.01)

(52) U.S. Cl.
CPC ..... *F42B 33/067* (2013.01); *F42B 1/028* (2013.01)

(58) Field of Classification Search
CPC ..... F42B 33/067; F42B 1/028
USPC ..... 102/275.1
See application file for complete search history.

(56) References Cited

U.S. PATENT DOCUMENTS 3,311,056 A * 3/1967 Noddin ..... C06C 5/04 102/275.8
3,373,686 A * 3/1968 Blain Jim W ..... F42B 15/38 89/1.14
3,486,410 A * 12/1969 Lake ..... F42B 15/38 89/1.14
3,698,281 A * 10/1972 Brandt ..... C06C 5/06 89/1.14
3,712,221 A * 1/1973 Voigt, Jr. ..... F42D 5/045 89/1.14
4,407,468 A * 10/1983 Bement ..... B26F 3/04 102/378
4,519,313 A * 5/1985 Leidel ..... F42D 1/04 102/310
4,648,227 A * 3/1987 Reusch ..... B64D 1/00 102/378
4,649,824 A * 3/1987 Guay ..... F42B 15/38 102/307
4,649,825 A * 3/1987 Quick ..... F42B 15/38 102/307
4,685,376 A * 8/1987 Noel ..... F42B 15/38 102/378
4,856,430 A * 8/1989 Gibb ..... F42B 3/08 102/307
4,905,601 A * 3/1990 Gabriel ..... F42B 3/08 102/302
4,978,089 A * 12/1990 Alquier ..... B64C 1/32 102/223
4,982,665 A 1/1991 Sewell et al.
(Continued)

OTHER PUBLICATIONS

United States Statutory Invention Registration, Titled: Linear Shaped Charge; registration No. H1216 published on: Aug. 3, 1993.

*Primary Examiner* — Michelle Clement
(74) *Attorney, Agent, or Firm* — Snell & Wilmer, L.L.P.

(57) ABSTRACT

A variable stand-off distance explosive cord assembly for a casing is disclosed. In various embodiments, the assembly includes an explosive cord configured for positioning at a stand-off distance from the casing and a thermally responsive material configured to vary the stand-off distance from a first distance to a second distance.

18 Claims, 5 Drawing Sheets

(56) References Cited

U.S. PATENT DOCUMENTS 5,170,004 A * 12/1992 Garrison ..... F42B 15/38 102/306
5,275,361 A * 1/1994 Fray ..... B64C 1/00 244/129.1
5,859,383 A * 1/1999 Davison ..... C06B 25/34 102/307
5,898,123 A * 4/1999 Fritz ..... F42B 15/38 102/275.11
6,021,715 A * 2/2000 Fritz ..... F42B 15/38 102/275.11
6,125,762 A * 10/2000 Fritz ..... B26F 3/04 102/378
6,286,430 B1 * 9/2001 Salort ..... F42B 15/38 102/312
6,363,855 B1 * 4/2002 Kim ..... F42B 39/20 102/378
6,382,232 B1 * 5/2002 Portmann ..... F16K 13/06 102/275.1
6,609,464 B1 * 8/2003 Hilden ..... B26F 3/04 102/306
7,367,738 B2 * 5/2008 Cleveland ..... B64G 1/641 102/275.12
7,373,885 B2 * 5/2008 Skinner ..... F42B 39/14 102/481
7,509,903 B2 * 3/2009 Facciano ..... F42B 15/38 102/377
7,530,314 B2 * 5/2009 Skinner ..... F42B 39/20 102/378
8,146,503 B2 * 4/2012 Murray ..... C06B 45/00 102/306
8,256,340 B2 * 9/2012 Bohs ..... F41F 3/077 220/265
8,356,727 B2 * 1/2013 Traxler ..... F42B 39/20 220/202
8,402,892 B1 * 3/2013 Scheid ..... C06C 5/06 102/217
8,505,458 B1 * 8/2013 Cannon ..... F42B 39/20 102/481
8,578,855 B2 * 11/2013 Diehl ..... F16L 35/00 102/377
8,584,588 B2 * 11/2013 Larousse ..... F42B 39/20 102/473
8,695,473 B2 * 4/2014 Kametz ..... F42B 15/38 102/378
8,720,722 B2 * 5/2014 Sunday ..... B65D 90/36 102/377
9,459,080 B2 * 10/2016 Collins ..... F42B 1/02
9,766,048 B2 * 9/2017 Graswald ..... F42B 3/22
9,857,157 B2 1/2018 Scheid et al.
2003/0010246 A1 * 1/2003 Bonnel ..... C06B 45/00 102/481
2004/0244358 A1 * 12/2004 Prytz ..... F42B 39/20 60/223
2005/0193917 A1 * 9/2005 Friedlander, III ..... F02K 9/38 102/481
2007/0095239 A1 * 5/2007 Skinner ..... F42B 39/14 102/481
2007/0240599 A1 * 10/2007 Pratt ..... E21B 43/117 102/307
2008/0047456 A1 * 2/2008 Li ..... F42D 1/05 102/310
2009/0101314 A1 * 4/2009 Lindner ..... F28D 15/02 165/104.26
2010/0000397 A1 * 1/2010 Pratt ..... E21B 43/117 89/1.15
2010/0064926 A1 * 3/2010 Melin ..... F42B 39/14 102/481
2010/0314402 A1 * 12/2010 Traxler ..... F42B 39/20 220/745
2011/0197779 A1 * 8/2011 Moore ..... F42B 3/087 102/331
2011/0197987 A1 * 8/2011 Koravos ..... F16L 59/026 138/149
2012/0181294 A1 * 7/2012 Sunday ..... B65D 90/36 220/745
2012/0227609 A1 * 9/2012 Volkmann ..... F42B 3/16 102/322
2012/0237293 A1 * 9/2012 McCoy ..... E01F 13/12 404/6
2013/0104765 A1 * 5/2013 Stecher ..... F42B 1/032 102/476
2013/0199843 A1 * 8/2013 Ross ..... F42C 15/188 175/4.54
2014/0034384 A1 * 2/2014 Fadul ..... E21B 43/116 175/2
2014/0119825 A1 * 5/2014 Castro ..... E01F 13/12 404/6
2015/0307242 A1 * 10/2015 Sneddon ..... B65D 39/0005 220/202
2017/0122259 A1 * 5/2017 Kliger ..... F02K 9/92
2018/0258724 A1 * 9/2018 Massey ..... E21B 31/1075
2018/0274342 A1 * 9/2018 Sites ..... F42B 3/22

* cited by examiner

VARIABLE STAND-OFF ASSEMBLY

FIELD

The present disclosure relates generally to thermally-initiated venting systems and, more particularly, to thermally-initiated venting systems having shaped charges with variable stand-off assemblies.

BACKGROUND

Various rocket motors and other devices containing a propellant or other energetic material housed within a casing may present hazards in the event of a "cook-off," which may be defined as a detonation of the energetic material due to external heating, such as occurs from an accidental fire or the like. An exposed rocket motor, for example, can react to exposure to heat, causing a violent explosion or uncontrolled thrust due to autoignition of the propellant resulting in the rocket firing but being out of control. The hazard may be reduced by providing the casing containing the energetic material with a mechanism for opening the casing to vent pressure prior to or during a cook-off event.

Cook-off events may be classified generally as either slow cook-off or fast cook-off events. The more extreme condition occurs during slow cook-off events, where the rate of heating is low—e.g., on the order of a few degrees per hour over a period of days. Under such circumstance, the entire munition approaches autoignition at a near uniform temperature, with the casing surrounding the energetic material maintaining its strength through the point of ignition. Autognition is followed by a rapid increase in pressure within the casing, leading to explosion or detonation. Faster heating, on the other hand, which may occur where the munition is exposed directly to fire (the so-called fast cook-off event), is considered less extreme and easier to counter. In this event, the flow of heat travels from outside the munition to the inside, resulting in the casing reaching a higher temperature than the energetic material. Exposure of the casing to high temperatures may weaken the casing prior to autoignition occurring, lessening the potential for resulting explosion or detonation.

SUMMARY

A variable stand-off distance explosive cord assembly for a casing is disclosed. In various embodiments, the assembly includes an explosive cord configured for positioning at a stand-off distance from a casing and a thermally responsive material configured to vary the stand-off distance from a first distance to a second distance.

In various embodiments, the thermally responsive material is positioned between the casing and the explosive cord. In various embodiments, the explosive cord defines a length along the casing and wherein the thermally responsive material extends along at least a portion of the length of the explosive cord. In various embodiments, the thermally responsive material comprises a plurality of blocks spaced along the length. In various embodiments, the thermally responsive material extends along the length of the explosive cord. In various embodiments, the first distance is configured to result in a scoring of the casing, following ignition of the explosive cord. In various embodiments, the second distance is configured to result in a cutting through of the casing, following ignition of the explosive cord. In various embodiments, the explosive cord is a linear shaped charge.

In various embodiments, the explosive cord is positioned between the thermally responsive material and the casing. In various embodiments, the first distance is configured to result in a scoring of the casing, following ignition of the explosive cord. In various embodiments, the second distance is configured to result in a cutting through of the casing, following ignition of the explosive cord. In various embodiments, the explosive cord is a linear shaped charge.

A rocket motor is disclosed. In various embodiments, the rocket motor includes a casing, an explosive cord configured for positioning at a stand-off distance from the casing and a thermally responsive material configured to vary the stand-off distance from a first distance to a second distance.

In various embodiments, the thermally responsive material is positioned between the casing and the explosive cord. In various embodiments, the explosive cord defines a length along the casing and wherein the thermally responsive material extends along at least a portion of the length of the explosive cord. In various embodiments, the thermally responsive material extends along the length of the explosive cord. In various embodiments, the first distance is configured to result in a scoring of the casing, following ignition of the explosive cord. In various embodiments, the second distance is configured to result in a cutting through of the casing, following ignition of the explosive cord.

A propellant containing device is disclosed. In various embodiments, the propellant containing device includes a casing housing an explosive charge, an explosive cord configured for positioning at a stand-off distance from the casing and a thermally responsive material configured to vary the stand-off distance from a first distance to a second distance. In various embodiments, the first distance is configured to result in a scoring of the casing, following ignition of the explosive cord, and the second distance is configured to result in a cutting through of the casing, following ignition of the explosive cord.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1A:
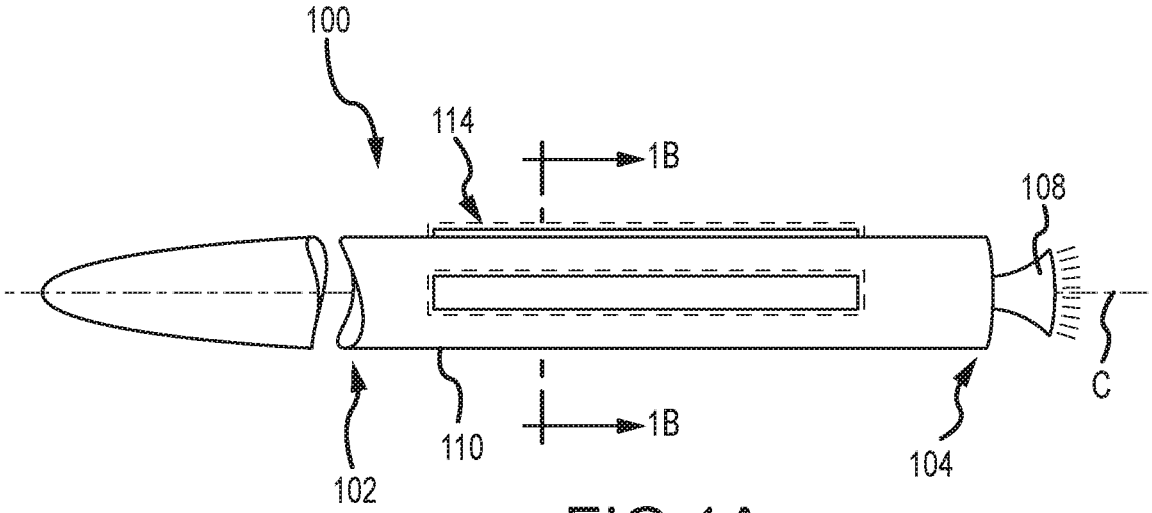
FIGS. 1A and 1B are side and axial views, respectively, of a casing configured for carrying an energetic material interior to the casing, in accordance with various embodiments.
Figure 1B:
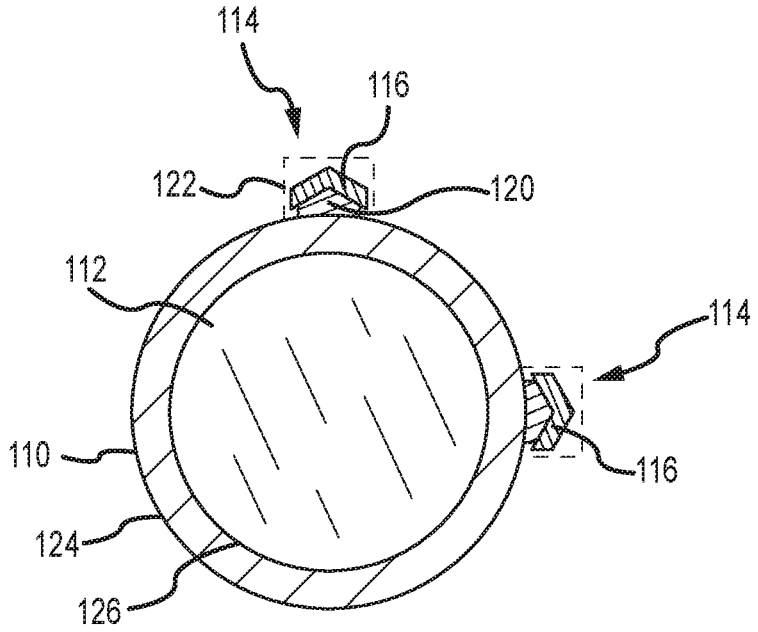

Referring now to the drawings, FIGS. 1A and 1B schematically illustrate a rocket motor 100 which, in various embodiments, may be a component of a rocket or some other device configured to contain a propellant or other energetic material. As described herein, the rocket motor 100 may include a first end 102 and a second end 104 spaced from the first end 102 along a central or longitudinal axis, C. In various embodiments, a cone 106 may be configured for positioning at the first end 102 and a nozzle 108 may be configured for positioning at the second end 104. Typically, the rocket motor 100 includes a casing 110 that houses a propellant 112 which, when ignited, exhausts through the nozzle 108, providing the rocket motor 100 with thrust. In various embodiments, the casing 110 is provided with an explosive thermal cord 114, configured to score or cut through the surface of the casing 110 when certain thermal events arise. By way of non-limiting example, in various embodiments, the explosive thermal cord 114 may comprise a linear shaped charge 116 positioned on and oriented longitudinally along the casing 110. The linear shaped charge 116, in various embodiments, is positioned adjacent a charge support member 120 and housed within a protective outer sheath 122.

As described further below, in various embodiments, the explosive thermal cord 114 or linear shaped charge 116 is configured to either score an outer surface 124 of the casing 110 or cut completely through the casing 110 depending on whether the rocket motor 100 is exposed to a fast cook-off event (e.g., rapid heating, on the order of seconds or minutes, resulting from direct contact with a flame) or a slow cook-off (e.g., slow heating, on the order of hours or days, resulting from indirect contact with a heat source) event, respectively. During a fast cook-off event, for example, longitudinal scoring of the outer surface 124 of the casing 110 provides a longitudinally stressed portion that allows the casing 110 to rupture longitudinally in the event propellant grains adjacent an inner surface 126 of the casing 110 ignite, thereby venting the resulting combustion products (typically at high pressure) through the ruptured portions of the casing 110, rather than through the nozzle 108. Venting the combustion products through the side of the casing 110 prevents the rocket motor 100 from uncontrolled flight following ignition of the propellant 112 proximate the inner surface 126 due to heating of the casing 110 from direct exposure to fire (e.g., a fast cook-off event), which may occur during storage or transport or even while the rocket motor 100 is secured, for example, under the wing or fuselage of an aircraft prior to flight. During a slow cook-off event, longitudinal cuts through the casing, from the outer surface 124 to the inner surface 126, reduce the likelihood of a detonation of the propellant 112, in its entirety, following simultaneous autoignition of most, if not all, of the propellant within the casing 110.

Figure 2A:
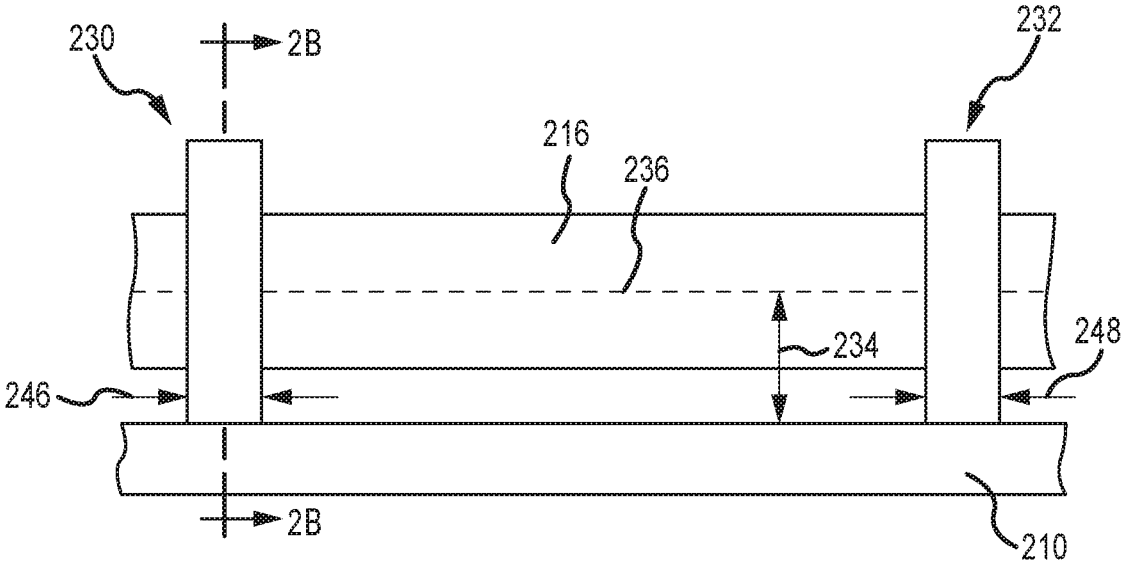
FIGS. 2A and 2B are side and axial views, respectively, of a variable stand-off mechanism, in accordance with various embodiments.
Figure 2B:
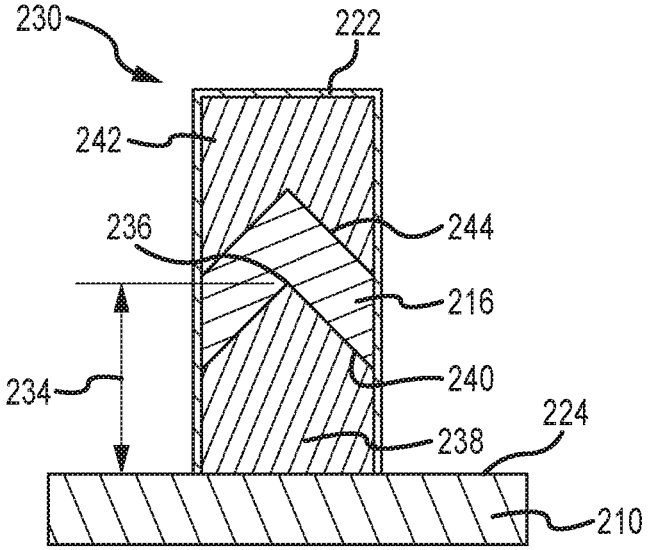
Figure 3:
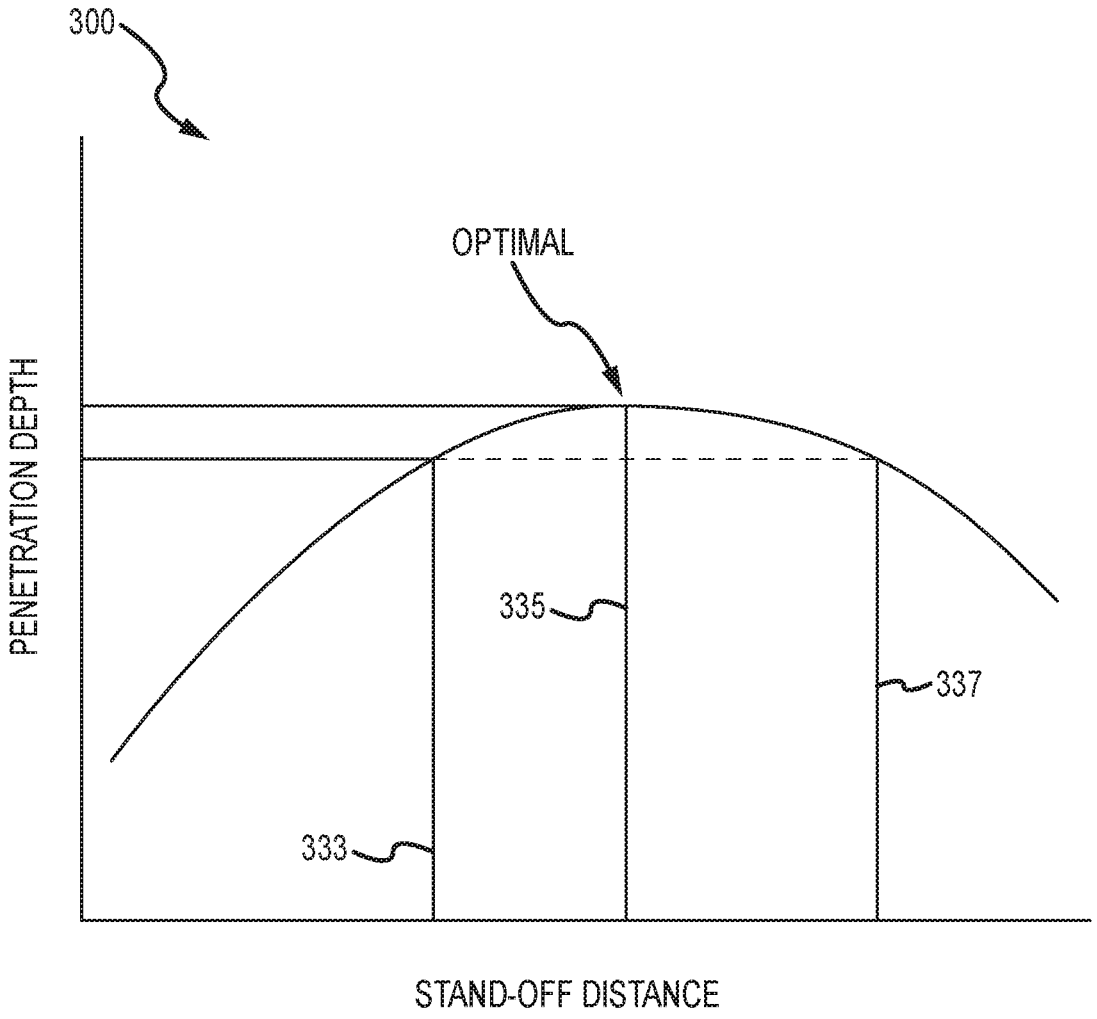
FIG. 3 is a graph generally depicting penetration depth as a function of standoff distance for a linear shaped charge, in accordance with various embodiments.

Referring now to FIGS. 2A and 2B, schematic side and axial views of a section of a casing 210 having a linear shaped charge 216 positioned thereon, respectively, are provided in accordance with various embodiments. A first variable stand-off mechanism 230 is provide at a first location and a second variable stand-off mechanism 232 is provided at a second location, spaced longitudinally along a central or longitudinal axis, C, from the first location. In various embodiments, the linear shaped charge 216 is positioned at a stand-off distance 234 from an outer surface 224 of the casing 210. The stand-off distance 234 may be defined, in various embodiments, as the distance running normal from the outer surface 224 of the casing 210 to an inner apex 236 of the linear shaped charge 216. Referring briefly to FIG. 3, a graph 300 depicts a typical relationship between penetration depth (y-axis) and stand-off distance (x-axis) for a linear shaped charge, such as the linear shaped charge 216 illustrated in FIGS. 2A and 2B. As depicted, an optimal stand-off distance is typical for any combination of characteristics of the linear shaped charge, which characteristics may include, for example, the type of explosive and ignition source and the materials or liner types used, if any, to surround the linear shaped charge. As will be described further below, in various embodiments, variable stand-off mechanisms, such as the first variable stand-off mechanism 230 and the second variable stand-off mechanism 232 described above, as well as the various embodiments described below, may be employed to control the penetration distance into a casing based on the environment surrounding the casing. More specifically, in various embodiments, variable stand-off mechanisms may be employed to control the degree of penetration into a casing based on whether the casing is subjected to thermal environments leading to slow cook-off or fast cook-off events.

Returning now to FIGS. 2A and 2B, in various embodiments, a first material 238 may be positioned below the linear shaped charge 216 or between the outer surface 224 of the casing 210 and an inner surface 240 of the linear shaped charge 216. Similarly, in various embodiments, a second material 242 may be positioned above the linear shaped charge 216 or adjacent an outer surface 244 of the linear shaped charge 216. In various embodiments, a protective outer sheath 222 may enclose the linear shaped charge 216, the first material 238 and the second material 242. In various embodiments, the first material 238 and the second material 242 may be selected such that their respective coefficients of thermal expansion result in the linear shaped charge 216 being urged either toward or away from the penetration surface, such as the outer surface 224 of the casing 210, depending on changes in the surrounding ambient temperature. Thus, for example, assuming a first coefficient of thermal expansion (e.g., linear expansion), $\alpha_1$, of the first material 238 is greater in value than a second coefficient of thermal expansion, $\alpha_2$, of the second material 242, then an increase in temperature will result in the first material 238 urging the linear shaped charge 216 farther away from the outer surface 224 of the casing 210. Similarly, assuming the first coefficient of thermal expansion, $\alpha_1$, of the first material 238 is lesser in value than the second coefficient of thermal expansion, $\alpha_2$, of the second material 242, then an increase in temperature will result in the second material 242 urging the linear shaped charge 216 closer to the outer surface 224 of the casing 210. As described further below, this feature of the variable stand-off mechanisms disclosed herein may be employed to adjust the expected penetration distance into a casing as a function of temperature.

Still referring to FIGS. 2A and 2B, in various embodiments, the first material 238 and the second material 242 are confined substantially to an axial dimension of a variable stand-off mechanism, such as, for example, a first axial dimension 246 of the first variable stand-off mechanism 230 and a second axial dimension 248 of the second variable stand-off mechanism 232. Thus, in various embodiments, a series of variable stand-off mechanisms, N in number, may be positioned along the length or a portion thereof of the linear shaped charge 216. In various embodiments, however, the first material 238 and the second material 242 may extend along the length of the linear shaped charge 216, providing, in essence, a continuous variable stand-off mechanism extending the length of the linear shaped charge 216.

Figure 4A:
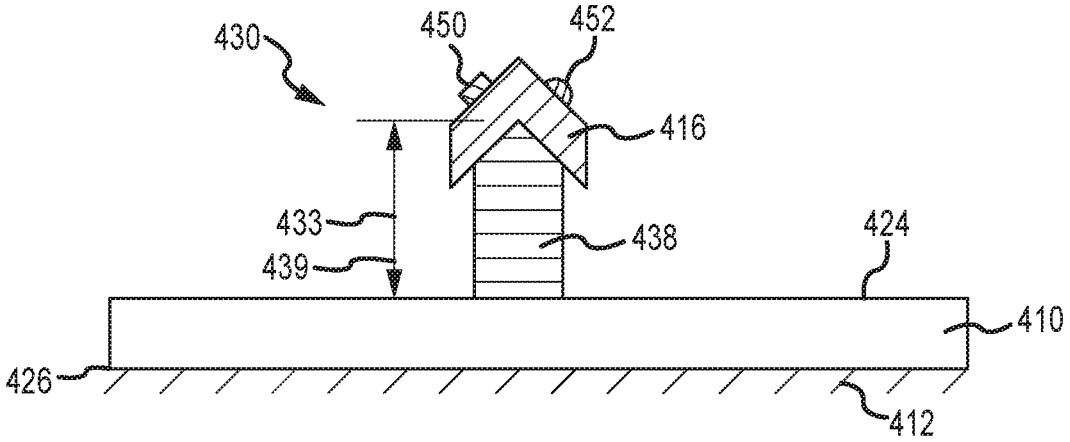
FIGS. 4A and 4B are axial views of a variable stand-off mechanism having an under-mount configuration, in accordance with various embodiments.
Figure 4B:
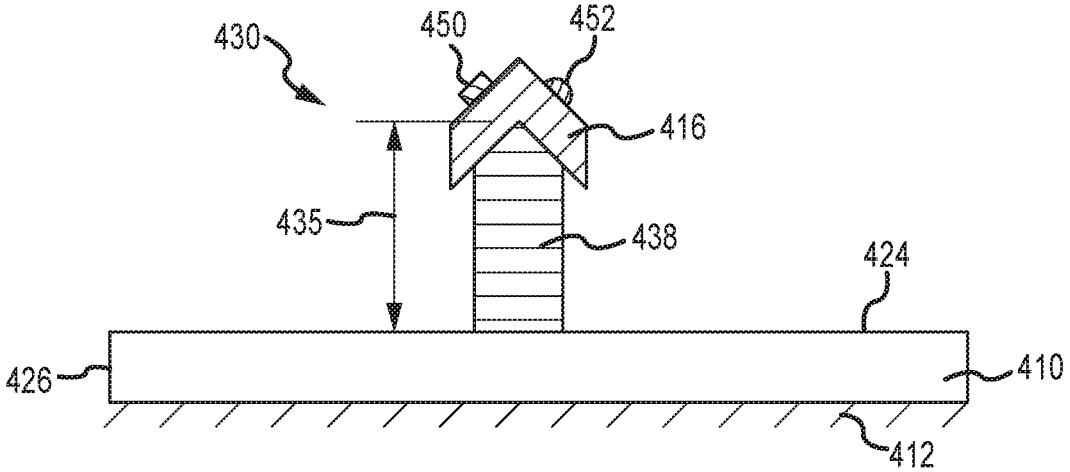

Referring now to FIGS. 4A and 4B, axial views of a variable stand-off mechanism 430 having an under-mount configuration are provided, in accordance with various embodiments. As illustrated, a section of a casing 410 has a linear shaped charge 416 positioned above a thermally responsive material 438; or, with regard to a general orientation, the thermally responsive material 438 is positioned between the casing 410 and the linear shaped charge 416. In various embodiments, the thermally responsive material 538 is characterized by a coefficient of thermal expansion (e.g., linear expansion), a. Referring to FIG. 4A, the linear shaped charge 416 is spaced an initial stand-off distance 433 from an outer surface 424 of the casing 410. The initial stand-off distance 433 will remain constant or nearly constant at an initial ambient temperature, $T_0$. In various embodiments, the initial stand-off distance 433 is sub-optimal in the sense of maximizing the penetration depth into the casing 410 following ignition of the linear shaped charge 416. With brief reference to FIG. 3, the initial stand-off distance 433 may be characterized as an initial stand-off distance 333 positioned to the left of (i.e., lesser in value than) an optimal stand-off distance 335.

Referring now to FIG. 4B, when exposed to an ambient temperature, $T_A$, greater than the initial ambient temperature, $T_0$, the thermally responsive material 438 will increase in length by a value proportional to the coefficient of thermal expansion, $\alpha$. Stated generally, the increase in length may be estimated by the relation $\Delta L/L \approx a\ \Delta T$, where L may be considered an initial length 439 of the thermally responsive material 438 (which is also the initial stand-off distance 433) and $\Delta T = T_A - T_0$. Thus, as indicated in FIG. 4B, a second stand-off distance 435, greater in value than the initial stand-off distance 433, will result following the thermally responsive material being exposed to a temperature $T_A > T_0$. In various embodiments, the second stand-off distance 435 is optimal in the sense of maximizing the penetration depth into the casing 410 following ignition of the linear shaped charge 416. With brief reference to FIG. 3, the second stand-off distance 435 may be characterized as the optimal or near optimal stand-off distance 335.

Referring still to FIGS. 4A and 4B, in various embodiments, the linear shaped charge 416 and the thermally responsive material 438 may be configured such that the initial stand-off distance 433 results in a scoring of the outer surface 424 of the casing 410 following ignition of the linear shaped charge 416. In various embodiments, the scoring of the outer surface 424 is sufficiently deep within the casing 410 to provide a longitudinally stressed portion that allows the casing 410 to rupture longitudinally during a fast cook-off event—e.g., where the casing 410 surrounds a propellant 412 within a rocket motor, such as the rocket motor 100 described above with reference to FIG. 1, that is directly exposed to a fire. In various embodiments, a fast cook-off ignition source 450 may be secured directly to or proximate the linear shaped charge 416 and be configured to ignite the linear shaped charge 416 when exposed to a temperature characteristic of a direct flame—e.g., a fast cook-off ignition temperature, $T_f \geq 3000°$ F.

Similarly, the linear shaped charge 416 and the thermally responsive material 438 may be configured such that the second stand-off distance 435 results in a complete or substantially complete cutting through of the casing 410 following ignition of the linear shaped charge 416. In various embodiments, the cutting through of the casing 410, from the outer surface 424 to an inner surface 426 of the casing 410, is sufficient to prevent detonation of propellant within the casing during a slow cook-off event—e.g., where the casing 410 surrounds the propellant 412 within a rocket motor, such as the rocket motor 100 described above with reference to FIG. 1, that is indirectly exposed to an ambient temperature $T_A > T_0$, but substantially less than $T_f$. In various embodiments, a slow cook-off ignition source 452 may be secured directly to or proximate the linear shaped charge 416 and be configured to ignite the linear shaped charge 416 when the temperature of the propellant 412 reaches or exceeds a temperature characteristic of indirect heating—e.g., a slow cook-off ignition temperature, $T_s \approx 300°$ F.—that occurs over a substantial period of time. As described above, the slow cook-off event may develop over a period of days, whereas a fast cook-off event may develop over a period of seconds or minutes.

Figure 5A:
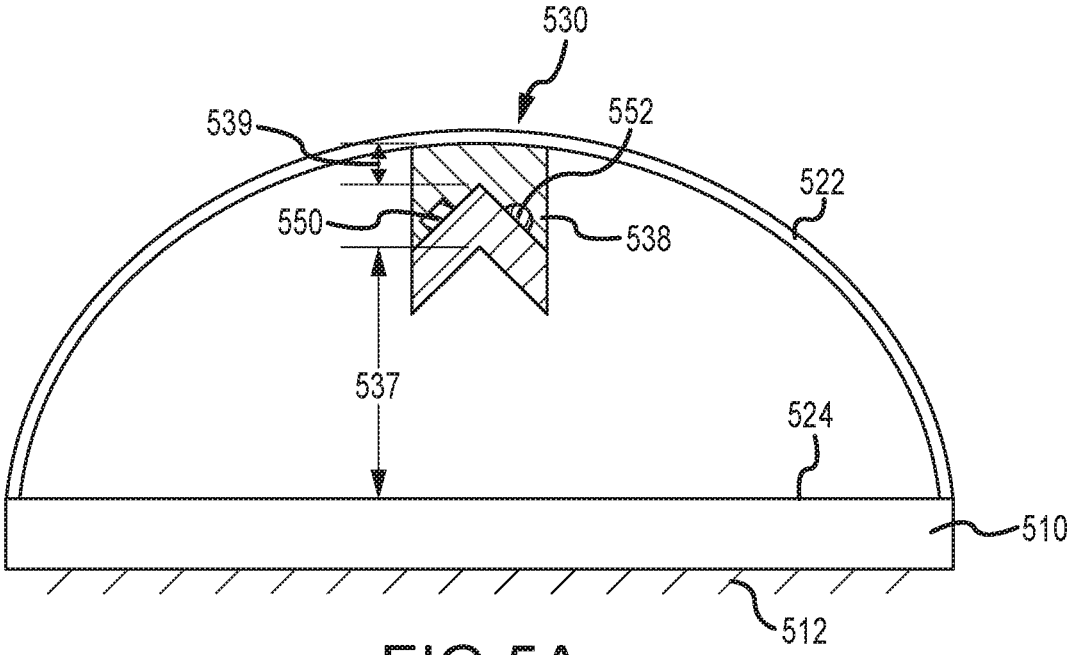
FIGS. 5A and 5B are axial views of a variable stand-off mechanism having an over-mount configuration, in accordance with various embodiments.
Figure 5B:
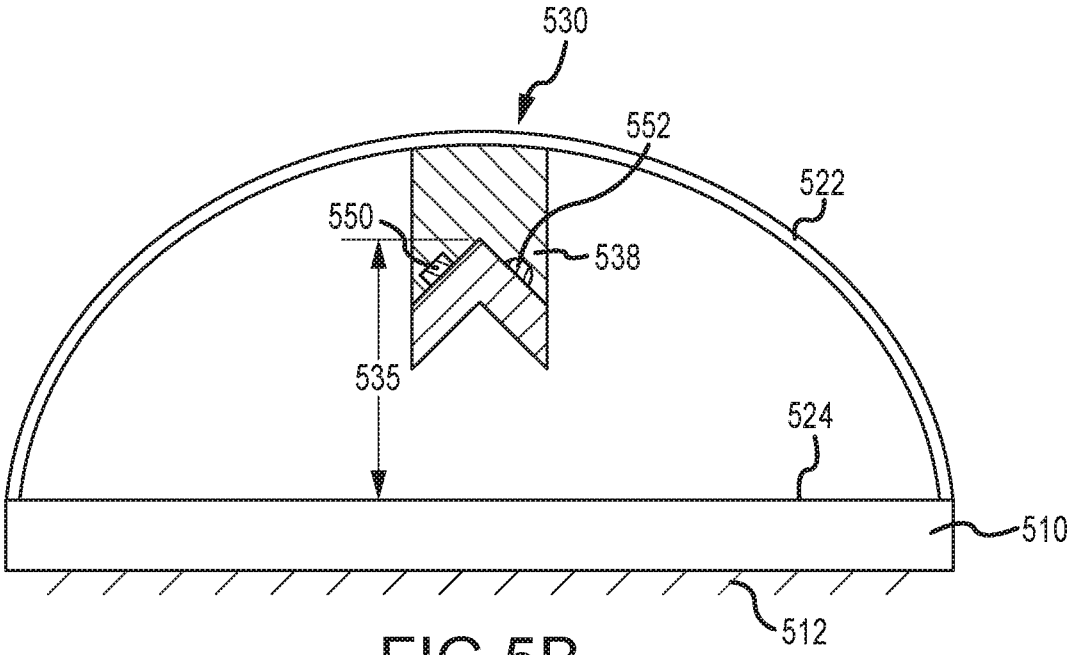

Referring now to FIGS. 5A and 5B, axial views of a variable stand-off mechanism 530 having an over-mount configuration are provided, in accordance with various embodiments. As illustrated, a section of a casing 510 has a linear shaped charge 516 positioned below a thermally responsive material 538; or, with regard to a general orientation, the thermally responsive material 538 is positioned such that the linear shaped charge 516 is between the casing 510 and the thermally responsive material 538. In various embodiments, the thermally responsive material 538 may be secured to a protective outer sheath 522 or similar structure and used to position the linear shaped charge 516 at a stand-off distance from an outer surface 524 of the casing 510. In various embodiments, the thermally responsive material 538 is characterized by a coefficient of thermal expansion (e.g., linear expansion), $\alpha$. As described below, materials contemplated as thermally responsive include those producing a change in length that is on the order of at least about 10%±2% of an initial length. Referring to FIG. 5A, the linear shaped charge 516 is spaced an initial stand-off distance 537 from the outer surface 524 of the casing 510. The initial stand-off distance 537 will remain essentially constant at an initial ambient temperature, $T_0$. In various embodiments, the initial stand-off distance 537 is sub-optimal in the sense of maximizing the penetration depth into the casing 510 following ignition of the linear shaped charge 516. With brief reference to FIG. 3, the initial stand-off distance 537 may be characterized as an initial stand-off distance 337 positioned to the right of (i.e., greater in value than) the optimal stand-off distance 335 described above.

Referring now to FIG. 5B, when exposed to an ambient temperature, $T_A$, greater than the initial ambient temperature, $T_0$, the thermally responsive material 538 will increase in length by a value proportional to the coefficient of thermal expansion, a. Similar to that described above, the increase in length may be estimated by the relation $\Delta L/L \approx \alpha\ \Delta T$, where L may be considered an initial length 539 of the thermally responsive material 538 and $\Delta T = T_A - T_0$. Thus, as indicated in FIG. 5B, a second stand-off distance 535, lesser in value than the initial stand-off distance 537, will result following the thermally responsive material being exposed to a temperature $T_A > T_0$. In various embodiments, the second stand-off distance 535 is optimal in the sense of maximizing the penetration depth into the casing 510 following ignition of the linear shaped charge 516. With brief reference to FIG. 3, the second stand-off distance 535 may be characterized as the optimal stand-off distance 335.

Referring still to FIGS. 5A and 5B, in various embodiments, the linear shaped charge 516 and the thermally responsive material 538 may be configured such that the initial stand-off distance 537 results in a scoring of the outer surface 524 of the casing 510 following ignition of the linear shaped charge 516. In various embodiments, the scoring of the outer surface 524 is sufficiently deep within the casing 510 to provide a longitudinally stressed portion that allows the casing 510 to rupture longitudinally during a fast cook-off event—e.g., where the casing 510 surrounds a propellant 512 within a rocket motor, such as the rocket motor 100 described above with reference to FIG. 1, that is directly exposed to a fire. In various embodiments, a fast cook-off ignition source 550 may be secured directly to or proximate the linear shaped charge 516 and be configured to ignite the linear shaped charge 516 when exposed to a temperature characteristic of a direct flame—e.g., a fast cook-off ignition temperature, $T_f \gtrsim 3000°$ F.

Similarly, the linear shaped charge 516 and the thermally responsive material 538 may be configured such that the second stand-off distance 535 results in a complete or substantially complete cutting through of the casing 510 following ignition of the linear shaped charge 516. In various embodiments, the cutting through of the casing 510, from the outer surface 524 to an inner surface 526 of the casing 510, is sufficient to prevent detonation of propellant within the casing during a slow cook-off event—e.g., where the casing 510 surrounds the propellant 512 within a rocket motor, such as the rocket motor 100 described above with reference to FIG. 1, that is indirectly exposed to an ambient temperature $T_A > T_0$, but substantially less than $T_f$. In various embodiments, a slow cook-off ignition source 552 may be secured directly to or proximate the linear shaped charge 516 and be configured to ignite the linear shaped charge 516 when the temperature of the propellant 512 reaches or exceeds a temperature characteristic of indirect heating—e.g., a slow cook-off ignition temperature, $T_s \approx 300°$ F.—that occurs over a substantial period of time, similar to that described above.

In various embodiments, the thermally responsive materials described above and employed to translate the explosive thermal cord from an initial stand-off distance to a second stand-off distance comprise materials capable of expansion in a linear direction on the order of at least about 10% (e.g., 10±2%) under a temperature difference of about 200° F. Suitable classes of such materials include thermoplastic materials, such as, for example, polyether ether ketone (PEEK), acrylonitrile butadiene styrene (ABS) and nylon. These materials exhibit coefficients of thermal expansion, a, on the order of 50E-06/° F. or greater, which results in ΔL/L on the order of 10% at a temperature difference, ΔT, on the order of 200° F. Advantageously, the materials also have melting temperatures sufficiently greater than about 300° F., such that if the ambient temperature does not become high enough to ignite the explosive cord during a slow cook-off event, the thermally responsive material will return to its initial length when the system—e.g., the rocket motor 100 described above with reference to FIG. 1—returns to its initial temperature.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching. Further, throughout the present disclosure, like reference numbers denote like elements. Accordingly, elements with element numbering may be shown in the figures, but may not necessarily be repeated herein for the sake of clarity.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A variable stand-off distance explosive cord assembly for a casing, comprising:

an explosive cord configured for positioning at a stand-off distance from the casing;

a first thermally responsive material configured to vary the stand-off distance from a first distance to a second distance, the first thermally responsive material positioned between the casing and the explosive cord; and a second thermally responsive material, the second thermally responsive material positioned on a side of the explosive cord opposite the casing and having a coefficient of thermal expansion greater or lesser than the coefficient of thermal expansion of the first thermally responsive material.

2. The variable stand-off distance explosive cord assembly of claim 1, wherein the explosive cord defines a length along the casing and wherein the first thermally responsive material extends along at least a portion of the length of the explosive cord.

3. The variable stand-off distance explosive cord assembly of claim 2, wherein the first thermally responsive material comprises a plurality of blocks spaced along the length.

4. The variable stand-off distance explosive cord assembly of claim 2, wherein the first thermally responsive material extends along the length of the explosive cord.

5. The variable stand-off distance explosive cord assembly of claim 2, wherein, following ignition of the explosive cord, the first distance is configured to result in a scoring of the casing.

6. The variable stand-off distance explosive cord assembly of claim 5, wherein, following ignition of the explosive cord, the second distance is configured to result in a cutting through of the casing.

7. The variable stand-off distance explosive cord assembly of claim 6, wherein the explosive cord is a linear shaped charge.

8. The variable stand-off distance explosive cord assembly of claim 1, wherein the explosive cord is positioned between the first thermally responsive material and the casing.

9. The variable stand-off distance explosive cord assembly of claim 8, wherein, following ignition of the explosive cord, the first distance is configured to result in a scoring of the casing.

10. The variable stand-off distance explosive cord assembly of claim 9, wherein, following ignition of the explosive cord, the second distance is configured to result in a cutting through of the casing.

11. The variable stand-off distance explosive cord assembly of claim 10, wherein the explosive cord is a linear shaped charge.

12. A rocket motor, comprising:

a casing;

an explosive cord configured for positioning at a stand-off distance from the casing;

a first thermally responsive material configured to vary the stand-off distance from a first distance to a second distance, the first thermally responsive material positioned between the casing and the explosive cord; and a second thermally responsive material, the second thermally responsive material positioned on a side of the explosive cord opposite the casing and having a coefficient of thermal expansion greater or lesser than the coefficient of thermal expansion of the first thermally responsive material.

13. The rocket motor of claim 12, wherein the explosive cord defines a length along the casing and wherein the first thermally responsive material extends along at least a portion of the length of the explosive cord.

14. The rocket motor of claim 13, wherein the first thermally responsive material extends along the length of the explosive cord.

15. The rocket motor of claim 13, wherein, following ignition of the explosive cord, the first distance is configured to result in a scoring of the casing.

16. The rocket motor of claim 15, wherein, following ignition of the explosive cord, the second distance is configured to result in a cutting through of the casing.

17. A propellant containing device, comprising:

a casing enclosing an explosive charge;

an explosive cord configured for positioning at a stand-off distance from the casing;

a first thermally responsive material configured to vary the stand-off distance from a first distance to a second distance, the first thermally responsive material positioned between the casing and the explosive cord; and a second thermally responsive material, the second thermally responsive material positioned on a side of the explosive cord opposite the casing and having a coefficient of thermal expansion greater or lesser than the coefficient of thermal expansion of the first thermally responsive material.

18. The propellant containing device of claim 17, wherein, following ignition of the explosive cord, the first distance is configured to result in a scoring of the casing, and, following ignition of the explosive cord, the second distance is configured to result in a cutting through of the casing.

* * * * *